US005339957A

United States Patent [19]

Carstens

[11] Patent Number: 5,339,957

[45] Date of Patent: Aug. 23, 1994

[54] HIGH FRICTION PACKAGE RETAINER

[75] Inventor: Ronald Carstens, Anacortes, Wash.

[73] Assignee: Key Tech Corporation, Mukilteo, Wash.

[21] Appl. No.: 27,806

[22] Filed: Mar. 8, 1993

[51] Int. Cl.[5] ..... B65D 19/44

[52] U.S. Cl. ..... 206/386; 106/36; 206/499; 428/493; 428/496

[58] Field of Search ..... 206/386, 597, 499; 106/36; 428/141, 359, 493, 496; 427/208; 53/157, 445; 156/327

[56] References Cited

U.S. PATENT DOCUMENTS

| | | | |
|---|---|---|---|
| 1,208,209 | 12/1916 | Prince | 428/493 X |
| 1,720,716 | 7/1929 | Blombery | 428/496 X |
| 2,167,634 | 8/1939 | Calvert | 428/493 X |
| 2,336,235 | 12/1943 | Fischer | 428/496 X |
| 3,490,583 | 1/1970 | Cook . | |
| 3,527,344 | 9/1970 | Taus et al. . | |
| 3,585,777 | 6/1971 | Pesch | 53/157 X |
| 3,598,677 | 8/1971 | Bergmeister et al. | 106/36 X |
| 3,776,145 | 12/1973 | Anderson et al. . | |
| 3,860,431 | 1/1975 | Payne et al. . | |
| 4,042,127 | 8/1977 | Brossia | 206/386 |
| 4,098,400 | 7/1978 | Brown | 206/386 X |
| 4,365,710 | 12/1982 | Swanson | 206/386 |
| 4,418,111 | 11/1983 | Carstens . | |
| 4,631,086 | 12/1986 | Jones . | |
| 4,834,739 | 5/1989 | Linker, III et al. | 604/385.1 |
| 4,993,907 | 2/1991 | Clark . | |
| 5,139,388 | 8/1992 | Martin . | |

*Primary Examiner*—Bryon P. Gehman

*Attorney, Agent, or Firm*—Jacobson, Price, Holman & Stern

[57] ABSTRACT

In order to stabilize stacks of cartons of consumer products which have ultra-low friction, glossy, point of sales graphics surfaces, on a pallet, without having to package the cartons in an outer container such as a corrugated cardboard box or the like, high-friction tie sheets are used between each superimposed layer of the carton. Each tie sheet has opposed ultra-high friction surfaces with a coefficient of friction of at least 0.8, up to 0.9 or even higher to itself.

16 Claims, 1 Drawing Sheet

HIGH FRICTION PACKAGE RETAINER

BACKGROUND OF THE INVENTION

This invention relates to the handling of cartons which have an ultra-low friction outer surface, such as cartons of consumer products and the like.

More and more commonly, consumer products such as soap powders, breakfast cereals, beverages and the like are packaged in containers having a vividly printed graphic outer surface, to provide advertising and to attract consumers' attention at points of sale. This trend toward high visibility graphics minimizes the need for display ads in self-service stores because the packages themselves function to present information in up to seven colors. Moreover, new retailing entities, such as the so-called club stores or discount stores, which are increasing in popularity, find they can sell more merchandise if is displayed in highly visible, eyecatching packaging.

The demand for more attractive containers has revolutionized the packaging surface itself so that it is more receptive to the new panoply of high visibility inks, graphics, and even hologram displays. All of these surfaces require a glossy overprint varnish which enhances the attractive presentation and maintains the integrity of the package graphics during filling, transportation and handling of the containers in general. Almost without exception, these high gloss overcoats produce ultra-low friction surfaces which are extremely slick or slippery. In fact, in the absence of these very low friction surfaces, the packages would rub together and thereby abrade and distort or destroy the graphic presentation. Also, with the high speed filling equipment currently in use, less slippery container surfaces tend to cause jam-ups, slow-downs and other undesirable production problems.

For all of the foregoing reasons, and others, this demand for ultra-low friction packaging surfaces will undoubtedly intensify with time. However, the very slipperiness of the product containers presents particular problems with respect to transporting the merchandise from manufacturer to wholesaler to retailer, and ultimately to display areas for the consumer in the store.

Due, at least in part, to their high gloss outer surfaces, it is generally difficult to directly palletize the product packages for transfer through the merchandise chain. Therefore, the individual cartons are commonly packed batchwise in containers or boxes which may themselves be more readily palletized. The boxes, generally made of corrugated paper or cardboard inherently have a higher coefficient of friction than the high gloss cartons and are, therefore, more readily handled and transported. Sometimes, even the cardboard boxes are treated with a heavy coating of a normal or conventional nonskid material, such as colloidal silica or alumina, to increase their frictional properties, and, thereby, facilitate palletizing the boxes for handling and transportation.

The use of such corrugated cardboard boxes obviously increases the cost of merchandising the product. For example, one must consider the cost of the boxes themselves, as well as the economic and environmental costs of recycling or destroying the boxes after use. Further, the labor and equipment costs in packing and unpacking the boxes exceeds the cost of the boxes themselves by many times. Such costs are undesirable, at best. In certain instances, such as in the club stores where prices are discounted and profit margins are limited to start with, these additional costs can become totally unacceptable.

Various concepts have been tried to minimize these problems. Packing boxes have been devised with almost "picture frame" sides, so that the inner contents are visible. Half-height trays have been used to facilitate displaying the high gloss merchandise. These "solutions" present their own obvious problems.

Entire pallets of individual product cartons have been stabilized for shipping by overwrapping horizontally with multiple turns of thin plastic film material such as stretch wrap. This approach effectively cocoons the cartons and avoids the needs for packing and unpacking cardboard boxes. However, palletized product cartons wrapped in this manner are still highly unstable and difficult to transport without carton movement. With high gloss product cartons, the instability of the pallet is such that simply transferring the stacked cartons to the stretch wrapper causes the cartons to slide relative to each other. Moreover, removing the stretch wrap, or attempting to move the pallet by a conventional fork lift truck from the receiving area in a club store or the like, to the merchandising floor for display once the stretch wrap has been removed, will also disrupt and destroy the stack. Therefore, further handling of the product cartons, either by individually placing them on shelves, or restacking them in some other fashion for display, becomes necessary.

The use of paper sheets between the layers of a pallet to help stabilize the pallet is a well-established, but infrequently used, practice. These sheets are variously known as tier sheets or tie sheets, or slip sheets in the case of one on the bottom for full pallet handling. They can be made of light to heavy weight kraft paper, or recycled chipboard sheets of various calipers, from 0.010 to 0.030 inches, depending on costs and conditions of use. In some rare instances, these pallet-sized sheets have had a conventional non-skid, such as colloidal alumina or silica, applied to one side to impart a modicum of slip resistance. The benefit, however, is usually minimal and in the instant case, with glossy, high graphic cartons, usually of no apparent benefit in handling.

SUMMARY OF THE INVENTION

It is evident that economies in materials and handling costs will accrue if the need for batchwise packing and unpacking of high gloss product packages in corrugated boxes and the like could be eliminated, and the individual cartons could be palletized directly. It is, therefore, a primary object of this invention to provide a means to stabilize a pallet of ultra-low friction, high gloss, product cartons so as to permit palletized stacks of such products to be delivered to a merchandising outlet and displayed for consumers with a minimum of labor intervention.

More specifically, the instant invention provides tie (or slip) sheets treated to provide both sides of the sheet material with an ultra-high coefficient of friction, and a pallet carrying a plurality of layers of high gloss product cartons having point of sales graphics, stabilized by; interposition of such tie sheets between adjacent layers.

A generally accepted test for slipperiness is TAPPI T-815, which is the inclined plane slip angle method and all references herein to slip angles are with reference to that test method.

When the surface of the product container exhibits a slip angle to itself, according to the TAPPI test, that is, two like surfaces placed against each other, of 10° or less (coefficient of friction of about 0.194), handling becomes an impossibility—on the order of new plastic playing cards. If the slip angle between two adjacent like packages is about 12°–14° (coefficient of friction about 0.21 to 0.25 ), handling of such packages on a pallet is difficult, at best. Generally speaking, any two things that exhibit a slip angle against each other below about 16°–17° (coefficient of friction about 0.3) is quite difficult to handle, and without special care and handling will engender some damage. Therefore, the instant inventive concepts are directed to palletizing high gloss product cartons with point of sales graphics having an outer surface with a slip angle to itself of less than 18°, according to TAPPI T-815.

The invention provides tie sheets (or slip sheets) having a substrate which is preferably made of chipboard, i.e., board material made from recycled paper, similar to that used as shirt boards or tablet backs, or heavy liner (or kraft) paper, i.e., the paper commonly used to make the inside and outside of an ordinary corrugated box. Both surfaces of the substrate are treated to provide an ultra-high coefficient of friction (on the order of at least about 0.8, and, preferably, even 0.9 or more), to itself, and a slip angle to itself in the range of at least about 40°, even up to 50° or more. The sheets are used between juxtaposed layers of rows of cartons having a high gloss, ultra-low friction surface, to enable the cartons to be stacked with sufficient stability against slippage for normal handling. By using the sheets in this manner, the slip angle between the surface of a stacked carton and a juxtaposed tie sheet surface, i.e., the effective slip angle between one layer of cartons and the next, can be increased to a level of 22°–35°. This resistance to movement enables the cartons to be palletized and handled or transferred without the need to batchwise pack the individual cartons in an outer container such as a corrugated box or the like.

Additional features and advantages of the invention will become apparent from the ensuing description and claims read in conjunction with the accompanying drawing.

DESCRIPTION OF PREFERRED EMBODIMENTS

Figure 1:
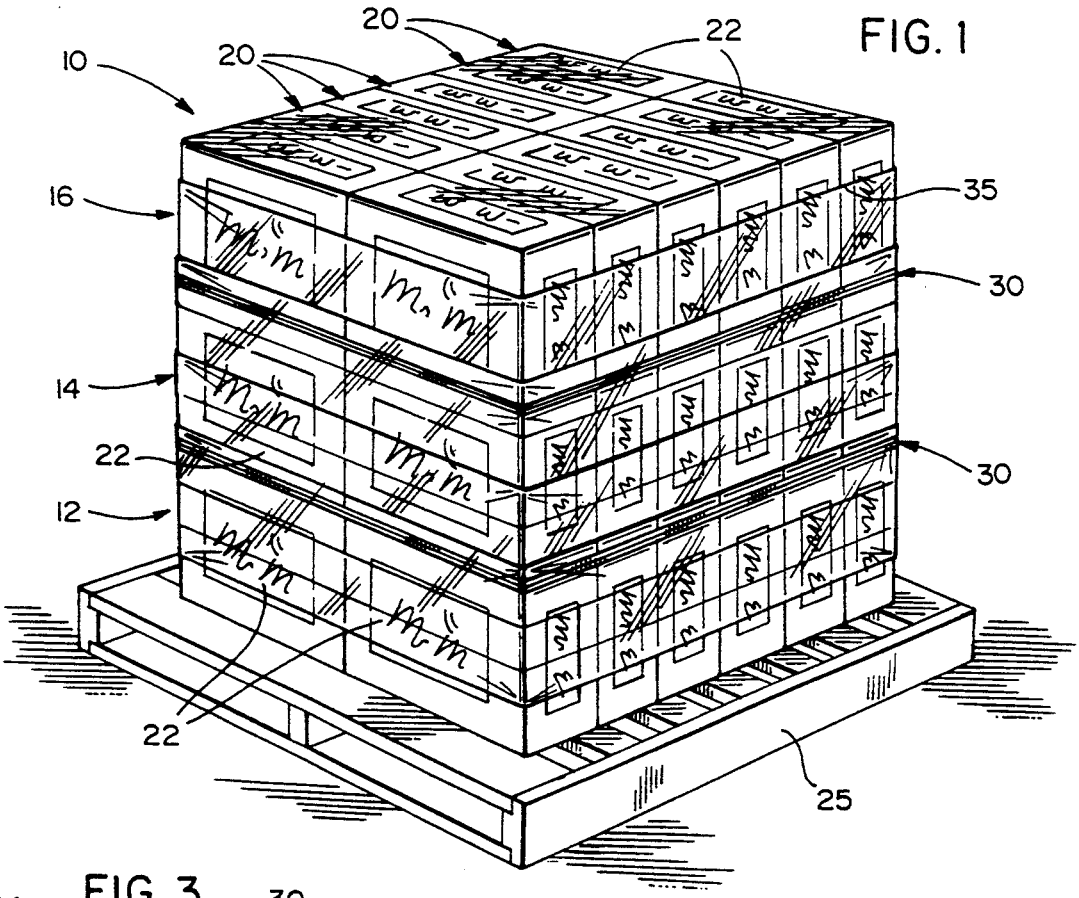
FIG. 1 is a perspective view of a palletized stack of high gloss cartons according to the instant invention, with a covering of plastic stretch wrap film.

FIG. 1 shows a stack 10 illustratively comprising three layers 12, 14 and 16, of individual high gloss cartons 20 formed on a conventional wooden or other pallet 25, with tie sheets 30 according to this invention interposed between the adjacent layers of the stack. An optional wrapping of plastic material securing the stack 10 for shipment is shown partially broken away at 35.

The cartons 20 may, for example, comprise packages of consumer products, such as breakfast cereal, soap powder or the like which have printed outer surfaces with point of sales graphics schematically shown at 22, covered by a high gloss, ultra-low friction coating typically having a slip angle against itself of less than 18° (coefficient of friction of less than 0.3). Because of the low slip angle between such cartons, the stack would heretofore collapse when moved while the stack was being taken to the stretch wrapper, during transportation, even after stretch wrapped, and when the stretch wrap was removed, making direct display, or even limited movement of the palletized stack, virtually impossible.

According to the instant invention, however, the tie sheets 30 interposed between the respective layers 12, 14 and 14, 16, dramatically increase the slip angle therebetween. In order to accomplish this result, the tie sheets must have both sides treated to provide an ultra-high friction surface, typically on the order of about 0.8 to 0.9 or higher (to each other), so that when positioned between the cartons, the slip angle between each carton and the juxtaposed tie sheet is 18° or more, preferably from about 22°–25°.

When a conventional wooden pallet is used, as illustrated at 25, it is not generally necessary to provide an ultra-high friction slip sheet according to this invention under the lowest row 12 of cartons 20. For pallets with lower friction surfaces, however, a slip sheet similar to the tie sheets 30 may be used.

Figure 3:
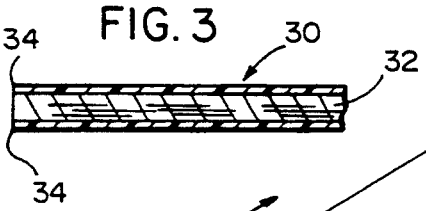
FIG. 3 is an enlarged sectional view taken on line 3—3 of FIG. 2.
Figure 2:
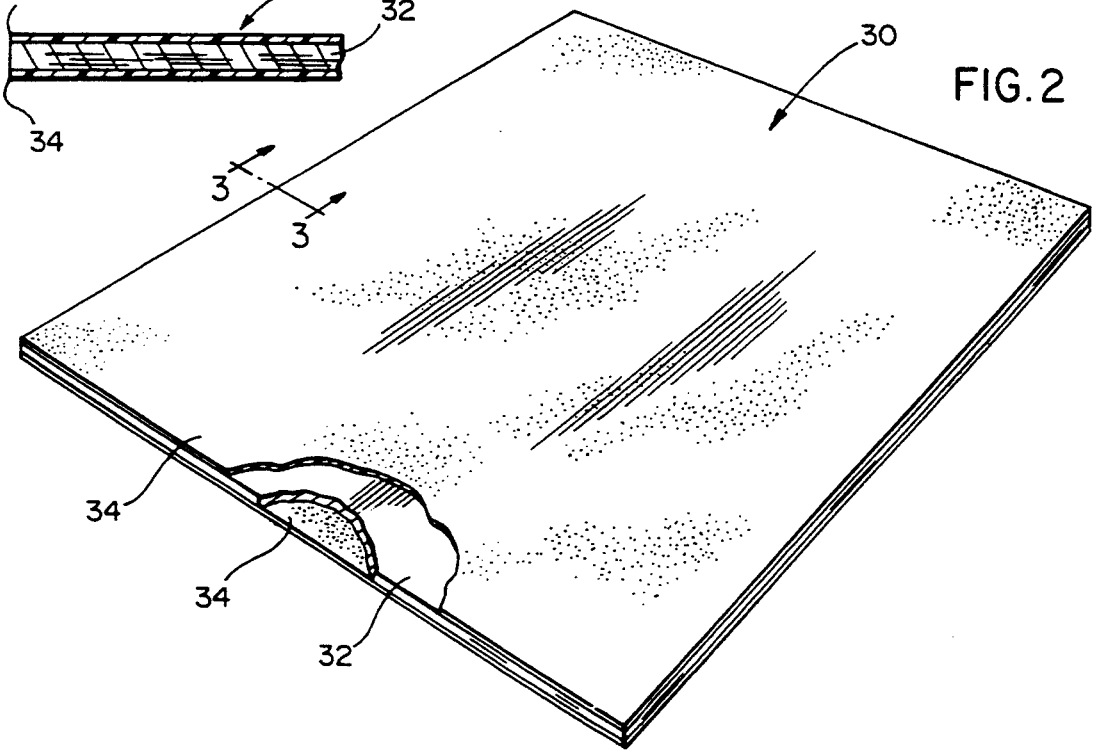
FIG. 2 is a perspective view, partly broken away, of a slip or tie sheet according to this invention wherein the coating layers on opposite sides of the substrate have been enlarged for illustrative clarity.

The preferred construction of a tie sheet 30 according to this invention is schematically shown in FIGS. 2 and 3. Each sheet 30 comprises a central substrate 32 dimensioned to suit the stack of cartons, and which may be a chipboard, or a kraft linerboard paper or the like. Each surface of the substrate is coated with an ultra-high friction tackified coating 34, providing a surface coefficient of friction of about 0.8 –0.9 to itself.

To manufacture tie sheets 30 according to their invention, a suitable substrate 32 of chipboard, for example, can be provided on each side with a coating 34 of a pressure-sensitive latex formula that has been modified to retain a slightly tacky character. Any pressure sensitive resin or latex may be employed that is capable, upon modification, of providing a slightly tacky surface when coated on paper over long periods of time and which will release from itself when stacked or in roll form. Of course, the relative thickness of the coating layers 34 is exaggerated in the drawing for illustrative clarity. In practice each layer will generally be less than 1% of the total thickness of a tie sheet 30.

While unsized chipboard or kraft paper may be used as a substrate, this can lead to variable results where the degree of tackiness and release may vary with age. Therefore, particularly in the case of chipboard, it is preferred that the substrate 32 be sized to a standard 10 minutes water drop test (according to the TAPPI T-432 test, the time for a predetermined drop of water to wet the board). In the case of linerboard, further treatment is usually not necessary since such materials are commonly sized to industry standards, which are sufficient for use in this invention. With linerboard, the preferred material for this invention has a weight of from about 26 to about 90 pounds per thousand square feet.

The paper or chipboard substrate can be coated by any one of many coating techniques known in the paper coating art, and by known coating apparatus such as three roll coaters, air knife coaters, wound wire coaters, and the like, followed by a conventional drying oven. The coating may be applied separately to opposite sides of the substrate, or simultaneously in a suitable device capable of coating and drying both sides of the substrate in one path. Also, the coating may be applied to cover each entire surface of a tie sheet 30, or the coating may be patterned, for example, as checkerboard squares, stripes, grid work or the like.

The invention is further illustrated in the following example:

EXAMPLE 1

Pallet-sized tie sheets according to this invention were made from substrates of 30 point chipboard, sized to 10 minutes water drop test. The substrates are passed through a three roll coater with rubber-coated, 5 inch diameter, rolls containing a coating consisting of 90 weight % PS-61 from Rohm & Haas and 10 weight % Jonwax 39 from Johnson Wax Co. PS-61 is a modified acrylic backbone pressure sensitive adhesive; Jonwax 39 is a wax emulsion which provides for release between the coated sheets and modifies the PS-61 so as to provide an enduring, slightly tacky character to the finished coated board. The sheets are then passed through a forced air convection drying oven to produce a 25° slide angle against typical 8°–10° angle slippery cartons, according to the TAPPI T-815 test. The sheets are again passed through the equipment to coat the reverse side.

The tie sheets made in this fashion were used between every layer of large soap box cartons having high gloss outer surfaces with point of sales graphics and a slip angle to themselves of about 8°. Use of the tie sheets in the manner illustrated in FIG. 1 produced a slip angle between the respective tie sheets and the juxtaposed carton surfaces of 22°, enabling the palletized cartons to be handled as required for normal merchandising without disruption to the stack, and with no need for the standard corrugated cardboard boxes commonly used to package such merchandise.

The following Table illustrates the advantages of building a pallet using tie sheets according to this invention. In this Table, all slip angles are the average results of three tests according to the TAPPI T-815 test procedures.

preprint corrugated, i.e., where the outside liner of the corrugated sandwich is preprinted with multicolor graphics and coated with a gloss varnish so that when the corrugated box is completed, it has a most striking graphic impact. As can be seen, the slip angles of such common commercial packages to themselves, range from 9° to 16°, all below the level at which they could be effectively palletized without need for batchwise packaging in corrugated boxes or the like.

The comparison of Column 2 with Column 1 shows the ineffectiveness of ordinary corrugated board, whether untreated, or even treated with a heavy coating of conventional nonskid, such as colloidal silica, in stabilizing a stack of such high gloss commercial cartons. Column 2a shows that the slip angle, when the high gloss containers are tested against an untreated corrugated board, are essentially unchanged. Even with the use of a nonskid treated corrugated board, unacceptably low slip angles are seen. This minimal improvement in slip angle, when the high gloss containers are tested against corrugated boards having a heavy nonskid coating, is surprising when it is recognized that the slip angle of the corrugated board against itself is raised from 18° to 36° when provided with a nonskid coating. Compare footnotes 1 and 2 to the Table.

In any event, it is clear that tie sheets, whether untreated, or treated with a heavy coating of conventional nonskid, fail to provide sufficiently better handling when interposed between the slippery high graphics surfaces of common commercial products.

Column 3 tabulates the results of testing the commercial package surfaces against tie sheets treated on both sides according to Example 1 above. The results, taken in aggregate are listed in Column 4 and show that, in contrast to the relative ineffectiveness using tie sheets of the prior art, whether treated with nonskid or not, (average increase in slip angle as compared to the use of no tie sheet at all equals zero), the use of tie sheets according to this invention evidence an appreciable increase in the slip angle (average increase of 16.5°). This increase in slip angle provides a significant improvement in the stability of the stacked cartons and in handling effec-

TABLE

| Product with Point of Sales Surface | 1 Slip Angle To Itself | 2 Slip Angle to 50% Recycled Corrugated Board a Untreated[1] | b Heavy NS[2] | 3 Slip Angle to Tie Sheet According to Example 1 of this Invention | 4 Approximately Average Change in Slip Angle a[3] | b[4] |
|---|---|---|---|---|---|---|
| Tide Cartons | 10° | 9° | 9° | 22° | −1° | 12° |
| Coke 12 pak Cartons | 9 | 13 | 12 | 26 | 3 | 17 |
| Duralast Auto Parts Preprint Corrugated Cartons | 13 | 14 | 14 | 32 | 1 | 19 |
| Gordon's Gin Preprinted Corrugated Carton | 14 | 12 | 12 | 32 | −2 | 18 |
| Chevron Preprint Corrugated Cartons | 16 | 14 | 14 | 35 | −2 | 19 |
| Dove Preprint Corrugated Cartons | 16 | 11 | 16 | 30 | −2 | 14 |
| | | | | | Avg. 0 | +16.5° |

[1]The recycled corrugated board has a slip angle to itself according to TAPPI T-815 of about 18°.
[2]When the same corrugated board surface is treated with a heavy coating of a normal or conventional nonskid (NS) such as colloidal silica the slip angle to itself is increased to about 36°.
[3]Difference between Column 1 slip angle and average of Columns 2a and 2b.
[4]Difference between Column 1 slip angle and Column 3.

In the above Table, Column 1 shows representative slip angles for a number of commercial point of sale high graphics packages. These packages range from glossy coated large and small cartons to different kinds of tiveness.

While only preferred embodiments of the invention have been described herein in detail, the invention is not limited thereby, and modifications can be made within the scope of the attached claims.

What is claimed is:

1. A stack of cartons each having a glossy printed outer surface with a slip angle relative to a same surface of less than of about 18°, the stack comprising at least first and second superimposed layers of said cartons, and a tie sheet interposed between the cartons in each adjacent layer to minimize sliding therebetween, said tie sheets each having upper and lower surfaces each having a coefficient of friction of at least 0.8 relative to a same surface, the slip angle between the outer surface of said cartons and its juxtaposed tie sheet surface being in excess of 18°.

2. The stack of claim 1, further comprising a pallet underlying and supporting the lowermost layer of said cartons.

3. The stack of claim 1 wherein said cartons have an outer surface with a slip angle of no more than 14° relative to a same surface.

4. The stack of claim 1 wherein the slip angle between the outer surface of each said carton and its juxtaposed tie sheet surface is about 22°.

5. The stack of claim 1 wherein each of said tie sheets includes a substrate comprising a paper board selected from the group consisting of chipboard and linerboard.

6. The stack of claim 5 wherein said substrate is chipboard sized to a standard 10 minutes water drop test.

7. The stack of claim 5 wherein said substrate is linerboard having a weight of from about 26 to about 90 pounds per thousand square feet.

8. The stack of claim 1 wherein each of said tie sheets comprises a substrate of sheet material coated on each surface with a pressure-sensitive latex.

9. A stack of cartons each having a glossy printed outer surface with a slip angle relative to a same surface of less than or about 18°, the stack comprising at least first and second superimposed layers of said cartons, and a tie sheet interposed between the cartons in each adjacent layer to minimize sliding therebetween, said tie sheets each having upper and lower surfaces each having a coefficient of friction of about 0.8 relative to a same surface, the slip angle between the outer surface of said cartons and its juxtaposed tie sheet surface being in excess of 18°.

10. The stack of claim 9, further comprising a pallet underlying and supporting the lowermost layer of said cartons.

11. The stack of claim 9, wherein said cartons have an outer surface with a slip angle of no more than 14° relative to a same surface.

12. The stack of claim 9 wherein the slip angle between the outer surface of each said carton and its juxtaposed tie sheet surface is about 22°.

13. The stack of claim 9 wherein each of said tie sheets includes a substrate comprising a paper board selected from the group consisting of chipboard and linerboard.

14. The stack of claim 13 wherein said substrate is chipboard sized to a standard 10 minutes water drop test.

15. The stack of claim 13 wherein said substrate is linerboard having a weight of from about 26 to about 90 pounds per thousand square feet.

16. The stack of claim 9 wherein each of said tie sheets comprises a substrate of sheet material coated on each surface with a pressure-sensitive latex.

* * * * *